US005105748A

United States Patent [19]

Harada et al.

[11] Patent Number: 5,105,748

[45] Date of Patent: Apr. 21, 1992

[54] FLUIDIZED BED COMBUSTION METHOD FOR BURNING WASTES

[75] Inventors: Yasuaki Harada, Kasukabe; Yusai Yamahata, Ichihara; Kazuhiko Ohi, Urayasu, all of Japan

[73] Assignee: Mitsui Engineering & Shipbuilding Co., Ltd., Tokyo, Japan

[21] Appl. No.: 657,848

[22] Filed: Feb. 20, 1991

[30] Foreign Application Priority Data

Feb. 22, 1990 [JP] Japan ..... 2-41753
Mar. 16, 1990 [JP] Japan ..... 2-66025
Jun. 25, 1990 [JP] Japan ..... 2-166313

[51] Int. Cl.[5] ..... F23G 5/00; F23G 7/00

[52] U.S. Cl. ..... 110/346; 110/245; 422/143

[58] Field of Search ..... 110/245, 346; 122/4 D; 165/104.16; 422/139, 143

[56] References Cited

U.S. PATENT DOCUMENTS 4,398,477 8/1983 Iwasaki ..... 110/346
4,744,312 5/1988 Narisoko et al. ..... 110/245
4,809,620 3/1989 Cosar ..... 110/245 X
4,879,958 11/1989 Allen et al. ..... 110/245

*Primary Examiner*—Edward G. Favors

*Attorney, Agent, or Firm*—Fay,Sharpe,Beall,Fagan,Minnich & McKee

[57] ABSTRACT

A fluidized bed combustion method for burning wastes using a fluidized bed furnace is not affected by a fluctuation in the quantity and quality of wastes fed into the furnace, if any, thereby preventing CO gas, etc. from discharging out of the furnace. The furnace has a number of air-diffusing tubes for feeding primary air to the fluidized bed in parallel with each other at the bottom of the fluidized bed, and a free space part formed above the fluidized bed for burning unburnt matter with a secondary air. Each air-diffusing tube has a number of nozzles provided along the axis of the tube and a primary air control device including an open-close damper for controlling the quantity of air to be fed through the tube. The primary air is fed into the fluidized bed through the air-diffusing tubes one after another according to a predetermined open-close pattern by the primary air control device so that the ratio of the air quantity Uo to the minimum fluidizing air quantity Umf (Uo/Umf) is in the range of 1.4 to 4 when the damper is opened and in the range of 0.5 to 2 when the damper is closed. The dampers are opened and closed at intervals of 1 to 10 seconds, preferably 2 to 10 seconds, and 10 to 100 seconds, respectively.

14 Claims, 9 Drawing Sheets

○: TIMING, WHEN OPENED

FLUIDIZED BED COMBUSTION METHOD FOR BURNING WASTES

BACKGROUND OF THE INVENTION

1. Field of the Invention

This invention relates to a fluidized bed combustion method for burning waste. More particularly, it relates to a combustion method for burning combustible wastes such as city wastes which vary in quantity the quality from time to time.

2. Description of the Related Art

Heretofore, one problem of a fluidized bed combustion method for burning city wastes, etc., occurs that as the quantity and quality of wastes fed are varied from time to time in that, unburnt matters remain in the combustion gases so that the exhaust includes black or harmful gases such as carbon monoxide, etc. This is an accelerated problem such that the smaller the scale of a combustion furnace, the greater the influence of the size of wastes that cause such a problem. In order to solve this problem, a method of preliminarily controlling air quantity and the like depending upon the quantity and quality of wastes and a method of finely crushing wastes and quantitatively feeding the crushed wastes into the furnace have been proposed, but there have been many restrictions in the aspect of design, making the practical use of these methods difficult.

SUMMARY OF THE INVENTION

The object of the present invention is to provide a fluidized bed combustion method that solves the problems specific to the above conventional fluidized bed combustion method and that is capable of completely burning wastes at a low combustion rate without being affected by a fluctuation in the quantity and quality of wastes fed into the fluidized bed furnace, if any, to thereby preventing CO gas, etc. from discharging out of the furnace and that is also capable of improving the percentage of steam recovery when the method is applied to a boiler, etc.

The present invention involves the use of a fluidized bed combustion method for burning wastes using a fluidized bed furnace having a fluidized bed, a number of air-diffusing tubes for feeding a primary air to the fluidized bed, arranged in parallel with each other at the bottom of the fluidized bed, and a free space part formed above the fluidized bed for burning unburnt matters with a secondary air. Each of the air-diffusing tubes has a number of nozzles provided along the axis of the tube and a primary air control means including an open-close damper for controlling the quantity of air to be fed to the tube. According to the invention, the feeding of the primary air into the fluidized bed through said air-diffusing tubes one after another is accomplished according to a predetermined open-close control pattern by means of said primary air control means so that the ratio of the air quantity Uo to the minimum fluidizing air quantity Umf (Uo/Umf) is in the range of 1.4 to 4 when said damper is opened and in the range of 0.5 to 2 when said damper is closed. Further the dampers are opened and closed at intervals of 1 to 10 seconds, and preferably 2 to 10 seconds, and 10 to 100 seconds, respectively.

DETAILED DESCRIPTION OF PREFERRED EMBODIMENTS

Figure 1:
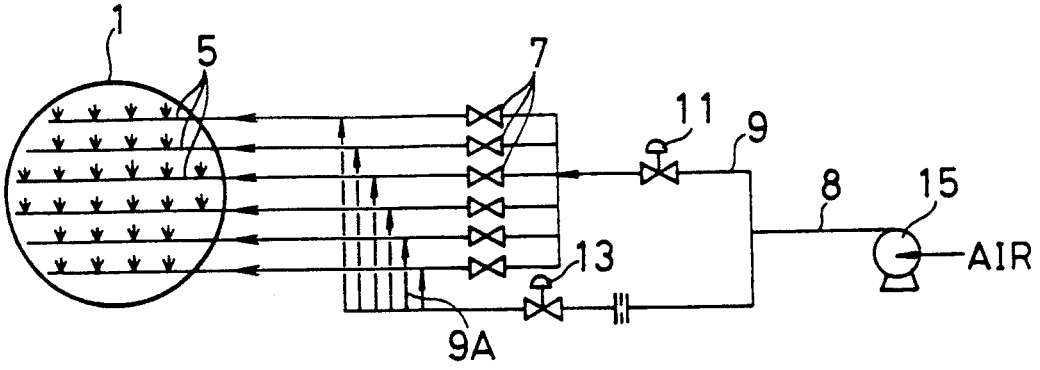
FIG. 1 shows a schematic view of a primary air control system used in the fluidized bed combustion method of the present invention.

The wastes to be burnt in the present invention may be those which are varied in the quantity and quality as well as in the bulk density, the water content, the generated heat, etc. As such wastes, city wastes, sludge, ores, etc. may be exemplified.

In the present invention, an open-close damper is provided at the air-diffusing tubes for feeding the primary air for combustion, and the damper is opened and closed so that the ratio of the flow quantity of the primary air Uo to the minimum fluidizing air quantity Umf, Uo/Umf, can be in the range of 1.4 to 4 when the damper is opened and in the range of 0.5 to 2 when the damper is closed, and the damper are opened and closed at intervals of 1 to 10 seconds and 10 to 100 seconds, respectively.

The above Umf is defined as a minimum flow quantity of a primary air which is possible to form a fluidized bed.

If the time interval is shorter than one second when the damper is opened, agitation by means of the fluidizing air is insufficient, while if the interval exceeds 10 seconds when the damper is opened, the quantity of air contributing to the combustion becomes excessive and it is impossible to obtain the CO reduction effect. Further, if U./Umf exceeds 4 when the damper is opened, the fluidizing air (Primary air) is fed in excess, the operation cost rises and the combustion exhaust gas is liable to be accompanied with ashes, while if Uo/Umf is less than 1.4 when the damper is opened, the agitation effect of the fluidized bed is insufficient.

Further, when the damper is closed, if its closed time is shorter than 10 seconds, the CO reduction effect is insufficient, while if it exceeds 100 seconds, temperature unevenness occurs in the fluidized bed so that local overheating proceeds to form clinkers, etc. Further, if Uo/Umf exceeds 2 when the damper is closed, the CO reduction effect s decreased, while if it is less than 0.5, it is impossible to secure the quantity of air required for burning wastes. The preferred ranges of the open-close time of the above damper and the Uo/Umf are 3 to 7 seconds a Uo/Umf of 2.0 to 3.0 when the damper is opened, while they are 30 to 60 seconds in Uo/Umf of 0.5 to 1.5 when the damper is closed.

In order to obtain the above range of values, the air-diffusing tubes may be provided with a conventional control valve or other control means in addition to an open-close damper.

In the present invention, by feeding the primary air according to the above-mentioned method, it is possible to obtain a preferable slow combustion state, but in order to obtain a more preferable one, it is preferable to control the temperature of the fluidized bed to fall within a range of 550° to 800° C., preferably 600° to 750° C., by adding a suitable quantity of an auxiliary fuel or water into the fluidized bed.

In the present invention, unburnt matter formed by a slow combustion in the fluidized bed is completely burnt by the secondary air in the free space part located above the fluidized bed. In order to completely burn the unburnt matter in the free space part, it is preferable to feed the secondary air at at least two points along the combustion gas flow direction. Further, it is preferred in the case of a cylindrical furnace, to provide secondary air-feeding tubes on the wall of the furnace so that a whirling flow can be formed at at least two points in the circumferential direction. Further, a flow rate of air to be delivered from the tubes is preferably 30 m/sec or higher. Further, secondary air-introducing tubes having a number of small holes may be provided in parallel in the length direction of the free space part, and preferably ring-form air-introducing tubes are provided in a plurality of stages in the length direction of the free space part. By such means, it is possible to mix the combustion gas with the secondary air effectively and to make uniform the concentration distribution, in the cross-sectional direction, of unburnt matter present in the combustion gas to effect a complete combustion.

As the secondary air introduced into the free space part above the fluidized bed, it is possible to use not only usual fresh air but also a low oxygen concentration gas such as combustion exhaust gas or a mixture of the combustion exhaust gas with fresh air having an oxygen concentration of about 10 to 21%. Use of such an air having a low oxygen concentration brings about a subsidiary effect of NOx inhibition.

Further, in the apparatus for carrying out the present invention, it is possible to provide a means for promoting mixing of the combustion gas with the secondary air, such as a grating provided in the cross sectional of the free space part, preferably at the secondary air-introducing part, wherein the combustion gas is divided into many portions, mixed with the secondary air, and then rejoined; a plurality of rods or tubes zigzag-arranged in the crosssection of the free space; or a plurality of rows of tubes which are provided laterally on one side of the free space part and arranged alternately in the flow direction of the combustion gas, so that the gas flows in a zigzag form, divided by the rows of tubes, to promote the combustion of unburnt matters. In the case of zigzag-arranged tubes, when holes for introducing the secondary air into the tubes are provided, it is possible to further promote mixing with the secondary air to obtain better results.

The present invention will be described in more detail referring to the accompanying drawings, but it should not be construed to be limited thereto.

Figure 2:
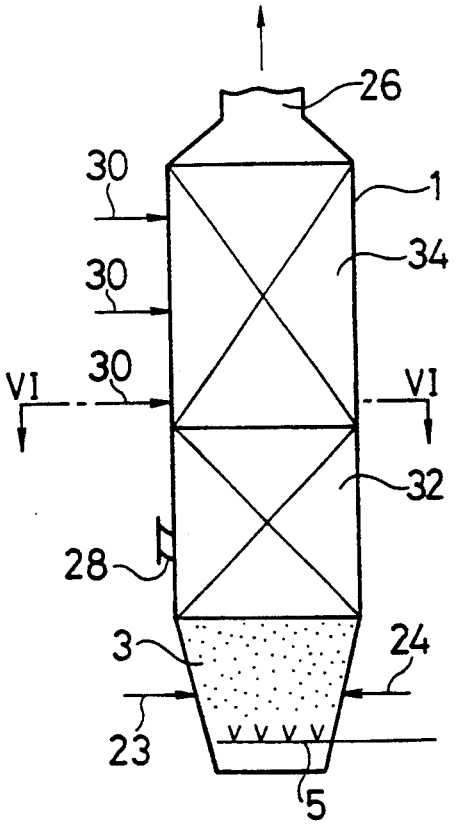
FIG. 2 shows a front schematic view of the fluidized bed combustion furnace used in the present invention.

FIG. 1 shows a plan cross sectional view illustrating an embodiment of a fluidized bed combustion furnace for conducting the present invention. FIG. 2 shows a front cross sectional view thereof. This furnace comprises, as shown in FIG. 2, a hollow body 1 of the furnace, a fluidized bed 3 formed at the bottom part of the hollow body 1, air-diffusing tubes 5 as a means for feeding a primary air to the fluidized bed 3, an inlet 28 of wastes provided at the hollow body toward the fluidized bed 3, a primary combustion zone 32 and secondary combustion zone 34 formed in the free space part above the fluidized bed 3, and an exit 26 of a combustion exhaust gas provided at the top of the hollow body 1.

The air-diffusing tubes 5 are arranged in parallel at intervals of a predetermined length at the lower part of the fluidized bed 3. These tubes 5 each have open-close dampers 7 branched from tube 9 and having a control valve 11. The tube 9 is connected to a blower 15 through a pipe 8 as shown in FIG. 1. These tubes 5 are also connected to by-pass tubes 9A, respectively, branched from the pipe 8 through a control valve 13. Each air-diffusing tube 5 is provided with a number of nozzles for spouting a primary air along the axis of the tube.

Figure 5:
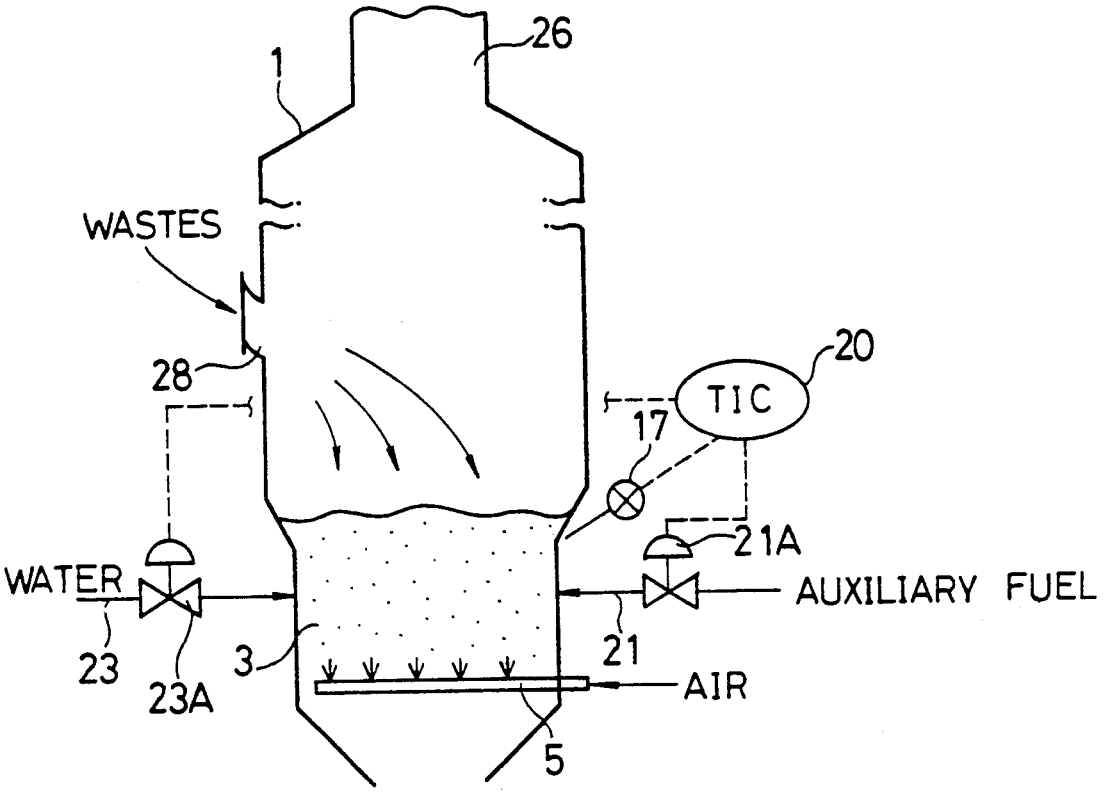
FIG. 5 shows a schematic view of the fluidized bed combustion furnace illustrating an embodiment of the temperature control components of the fluidized bed in the present invention.

Further, this apparatus is provided with a temperature detector 17 inserted into the fluidized bed 3 as shown in FIG. 5, a line 21 for feeding an auxiliary fuel (e.g. oil) to the fluidized bed 3, a control valve 21A provided on the line 21, a line 23 for feeding water to the fluidized bed 3 and a control valve 23A provided on the line 23, and a temperature-controlling device 20 connected to the control valves 21A and 23A, respectively, for controlling the flow amount of fuel or water to be added so that the temperature of the fluidized bed 3 can fall within a definite range, 550° to 800° C., for example.

Figure 7A:
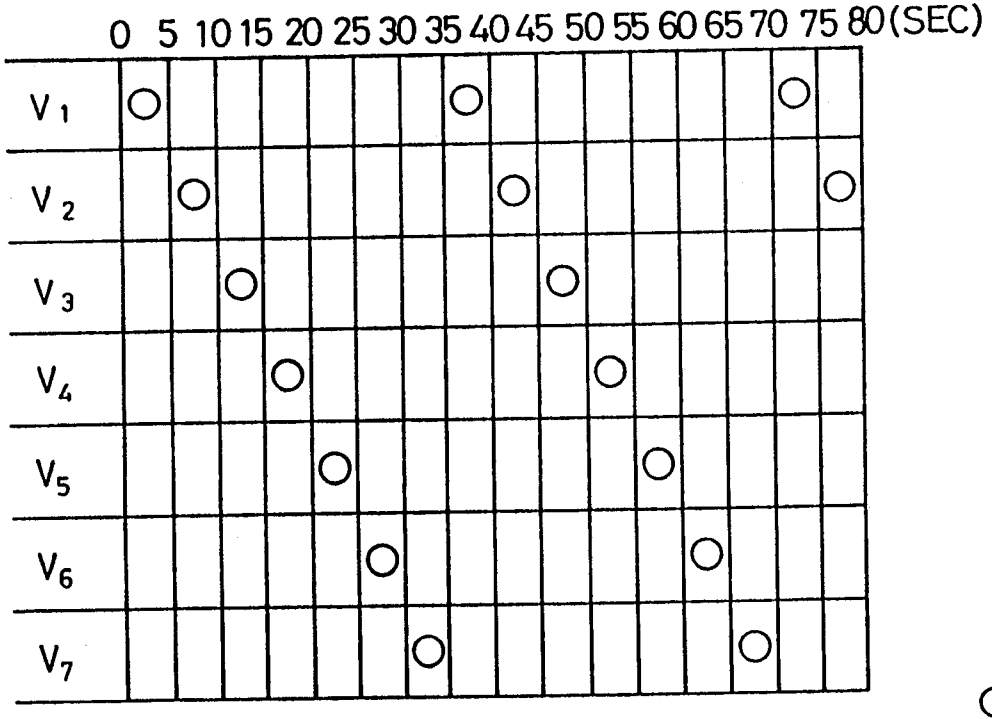
FIG. 7A and FIG. 8A each show a chart illustrating an open-close pattern of dampers $V_1$–$V_7$ for controlling the primary air fed to the fluidized bed through air-diffusing tubes arranged as illustrated schematically in FIGS. 7B and 8B, respectively, in accordance with embodiments of the present invention.
Figure 7B:
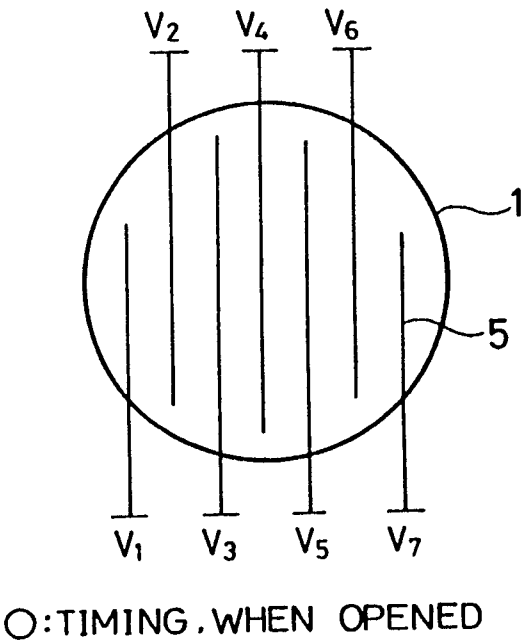
Figure 8A:
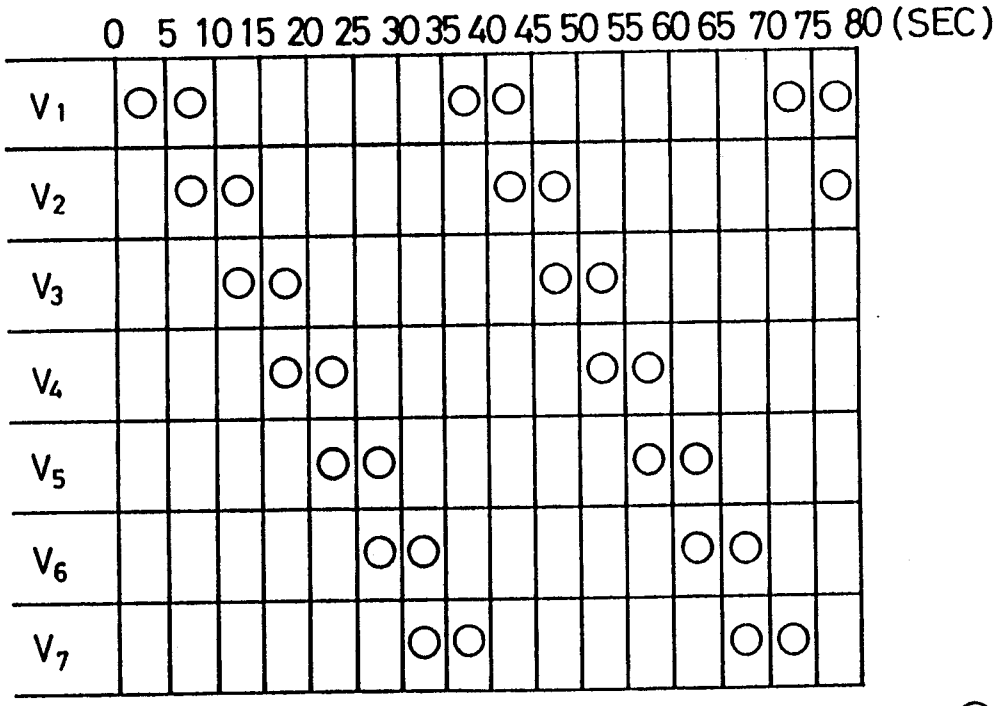
Figure 8B:
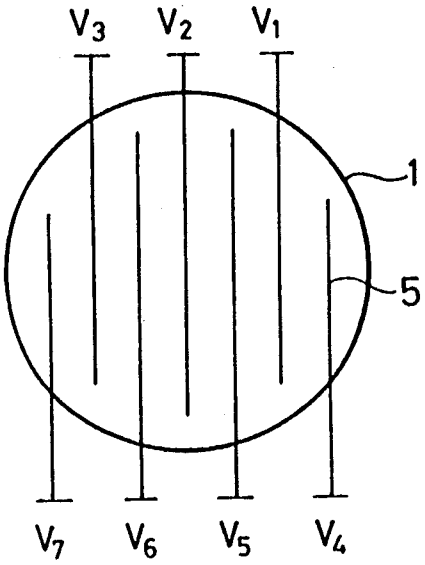

As to the control of the primary air to be introduced into air-diffusing tubes 5, the open-close timing of the respective dampers 7 (control valves) is carried out according to a definite pattern as shown in the charts of FIGS. 7A and 8A, respectively, for example. In these figures, $V_1$, $V_2$, $V_3$, $V_4$, $V_5$, $V_6$ and $V_7$ each represent a damper provided for the respective air-diffusing tubes arranged as shown schematically in FIGS. 7B and 8B. The symbol ◯ shows a time interval of 5 seconds when the damper is opened. In FIG. 7A, it is shown that each damper repeats to open for 5 seconds and to close for 30 seconds, having a delayed time of 5 seconds between the adjacent dampers. In FIG. 8A, it is shown that each damper repeats to open for 10 seconds and to close for 25 seconds, having a delayed time of 5 seconds between the opening and closing at adjacent dampers. It is important that at least one of these dampers $V_1$ to $V_7$ is opened so that no dead portion in the fluidized bed occurs during operation.

On the other hand, a definite quantity of air is always fed into the respective tubes 9A via the valve 13 without regard to, the above open-close control of the dampers.

Figure 3:
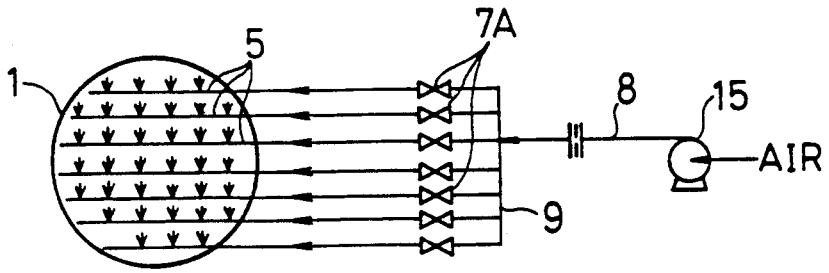
FIG. 3 shows a schematic view of another primary air control system used in the method of the present invention.

Instead of providing valve 13 and by-pass tubes 9A of FIG. 1, as shown in FIG. 3, a damper 7A having a low limiter may be used. In this case, the low limiters function so that a definite air quantity always passes through the dampers 7A at the time of close thereof.

Figure 4:
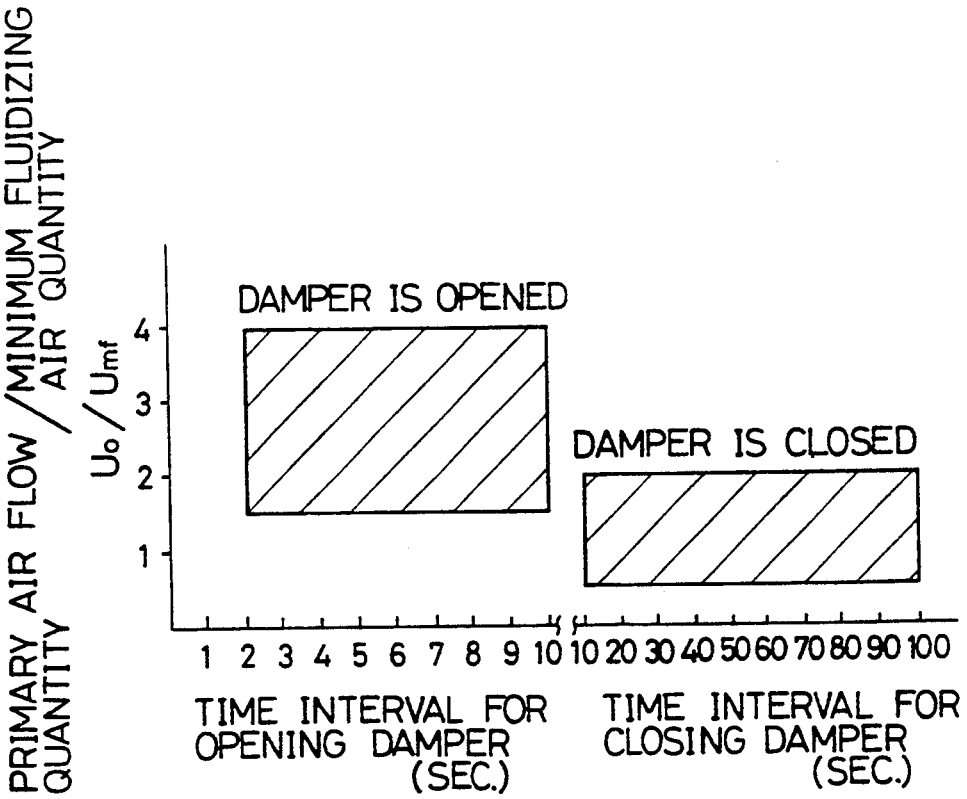
FIG. 4 shows a chart illustrating ranges of Uo/Um and a time interval for the opening and closing of a damper in the method of the present invention.

As to the air quantity control in the apparatus of FIG. 1, the valve 13 is first opened and a minimum air quantity required for combustion, that is, a quantity of the primary air corresponding to a value more than the lower limit of Uo/Umf as shown in FIG. 4 when the damper is closed, is fed to the respective air-diffusing tubes 5 via the line 9A, and further, the respective dampers 7 for the respective air-diffusing tubes 5 are controlled to be opened or closed so that the Uo/Umf can fall within the range of the shaded area containing oblique lines as shown in FIG. 4, when the damper is opened. A time interval for opening is in the range of 2 to 10 seconds, and Uo/Umf is in the range of 1.4 to 4, whereas when the damper is closed, a time interval for closing is in the range of 10 to 100 seconds, and Uo/Umf is in the range of 0.5 to 2.0.

Further, the temperature is continuously measured by the temperature detector 17 as shown in FIG. 5 and controlled so that the fluidized bed temperature can fall within a range of 550° to 800° C. That is, when the fluidized bed temperature is going to exceed 800° C., the valve 23A is opened by the temperature control device 20, thereby feeding a suitable quantity of water into the fluidized bed to cool the bed. On the other hand, when the fluidized bed temperature lowers down to lower than 550° C., the valve 21A is opened, thereby feeding a suitable quantity of the auxiliary fuel to return the fluidized bed temperature to a predetermined temperature within the range by combustion heat of the fuel.

As to other conditions of the fluidized bed, the average diameter of sand as a fluidizing medium is preferred to be smaller, and it is usually 0.3 to 1.5 mm, preferably 0.3 to 0.8 mm. In addition, the primary air is preferred to be mixed with combustion exhaust gas in a suitable proportion in order to carry out a low NOx combustion.

Figure 6:
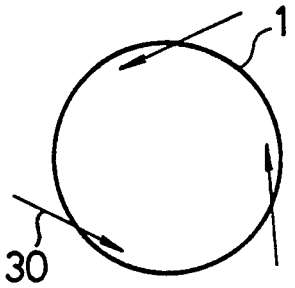
FIG. 6 shows a cross sectional view taken along the VI–VI line of FIG. 2.

In the embodiment of FIG. 2, a free space part above the fluidized bed in the furnace consists of a primary combustion zone 32 and a secondary combustion zone 34 formed in this order. In the primary combustion zone 32, combustible gas generated from the fluidized bed is burnt. Further, in the secondary combustion zone 34, the air-feeding tubes 30 are inserted at three stages in the gas flow direction so as to form a whirling flow in the circumferential direction on the wall of the furnace, as shown in FIG. 6.

The combustion gas including unburnt matter ascending through the secondary combustion part 34 is mixed with the secondary air fed through the secondary air-feeding tubes 30 at three stages, thereby burning completely unburnt matter in the gas. The combustion gas free of unburnt matter is exhausted from the exit 26 of the furnace.

In order to promote mixing of the combustion gas with a secondary air, the following embodiments are illustrated.

Figure 9:
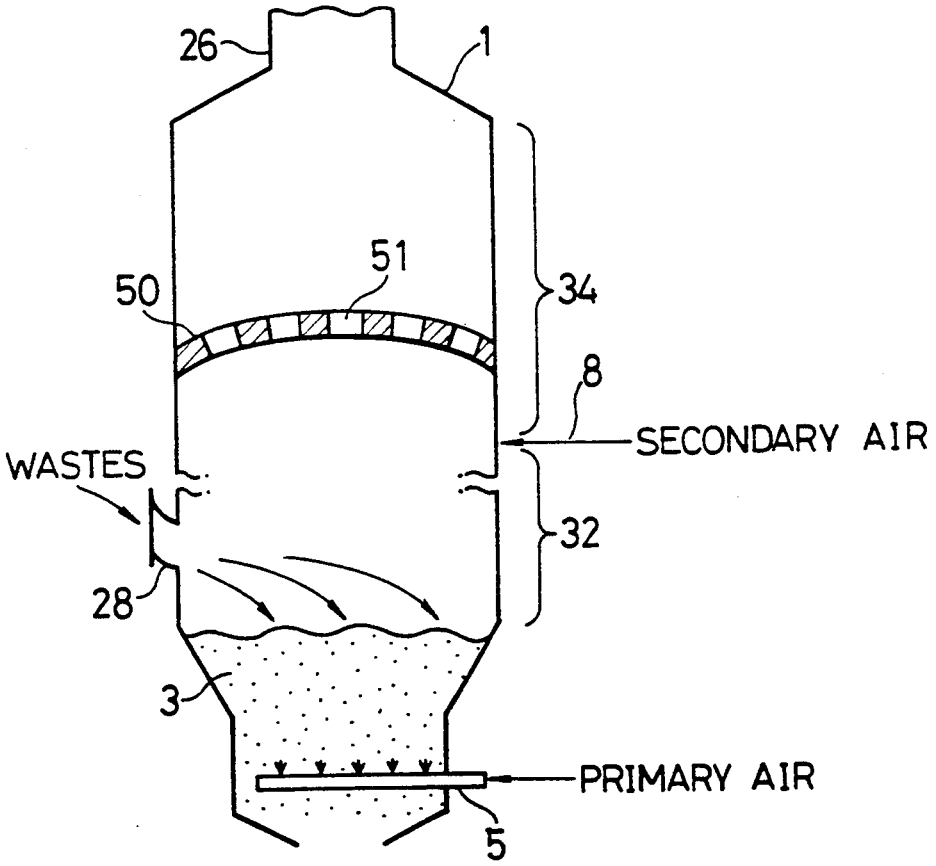
FIG. 9 shows a schematic view illustrating an embodiment of a furnace that promotes mixing of the secondary air with the combustion gas in the present invention.

FIG. 9 shows a cross sectional of a gas-dividing member provided at the secondary combustion zone of a fluidized combustion furnace. In this figure, a combustion gas-dividing grating 50 is provided at the secondary combustion zone 34 and just above the secondary air inlet. The part of the furnace bridging from the fluidized bed to the secondary air inlet corresponds to the primary combustion zone 32 referred to in the present invention, and the part bridging from the secondary air inlet to the combustion gas exit 26 of the furnace corresponds to the secondary combustion zone 34 referred to in the present invention.

Figure 10:
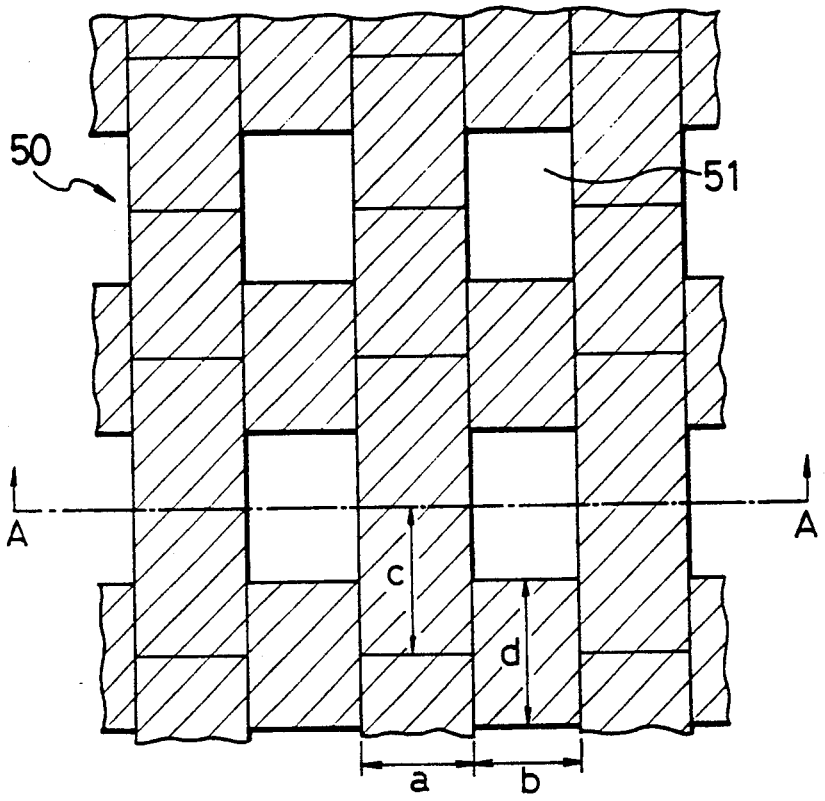
FIG. 10 shows a plan cross sectional view of a grating 50 used in the furnace shown in FIG. 9.
Figure 11:
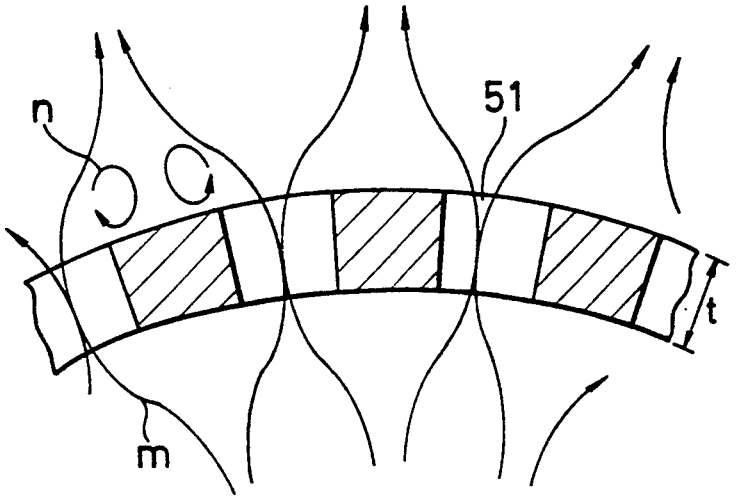
FIG. 11 shows a front cross sectional view of the grating 50 of FIG. 10.

FIG. 10 shows a plan cross sectional of the combustion gas-dividing grating 50 used in the furnace of FIG. 9. FIG. 11 shows a cross sectional cut along the A—A line of FIG. 9. As shown in these figures, the gas flow m is divided when it enters the opening parts 51 of the grating, and the divided flows are rejoined when they leave the opening parts to form small eddies n in the vicinity of the exits, so that mixing with the secondary air is promoted. In FIG. 10 and FIG. 11, the arch radius of the grating 50, the arch thickness t, and the shape of the grating (the dimensions a, band c in FIG. 10) have no particular limitation, but the opening ratio of the grating i.e. the proportion of the gas-passing area to the furnace cross sectional area is preferably 50% or less. It is considered that the rapid reduction in the unburnt matter in the combustion gas is achieved due to the promotion of the above mixing of the gases and the contact of the gas with the red-hot grating.

Figure 12:
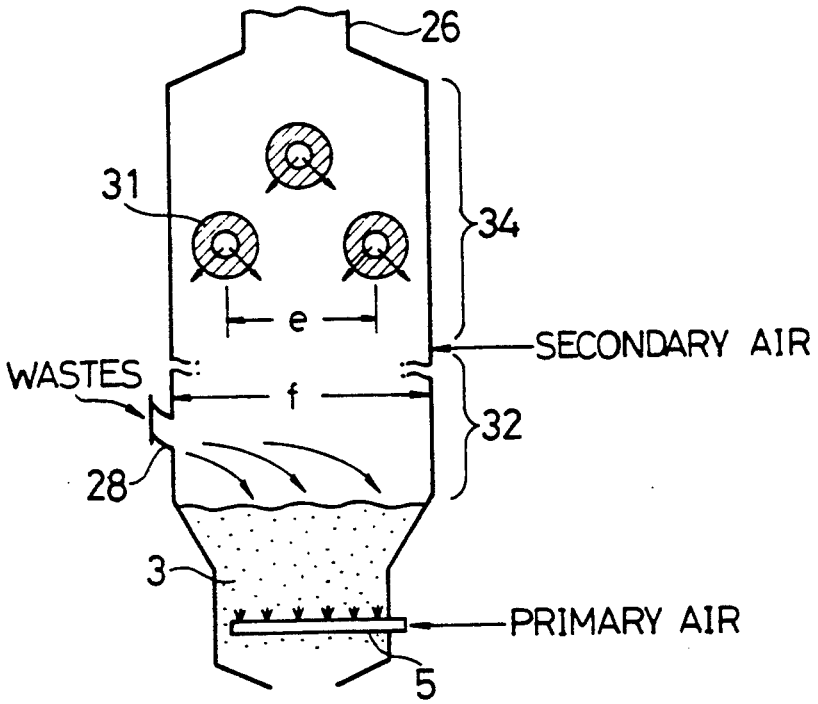
FIG. 12 shows a schematic view illustrating an embodiment of a furnace that promotes mixing of the secondary air with the combustion gas in the present invention.
Figure 13:
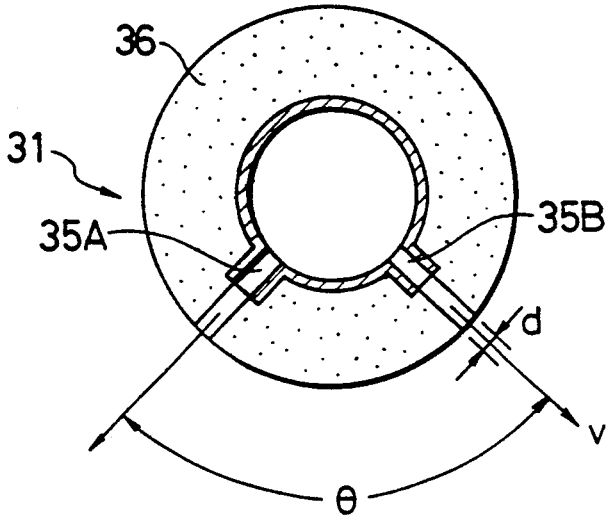
FIG. 13 shows a crossectional view of a hollow tube 31 used in the furnace shown in FIG. 12.

FIG. 12 shows another embodiment of a gas-dividing means wherein three hollow tubes 31 almost horizontally penetrating through the secondary combustion zone 34 are provided. FIG. 13 shows the cross sectional of the tube 31. In this figure, secondary air-spouting nozzles 35A and 35B are provided at the under part of the tubes and the periphery of the respective tubes is covered with a refractory material 36.

The number of the spouting nozzles is preferred to be large. The diameter of the spouting nozzles is preferred to be as small as 50 mm or less. A more preferable diameter is within a range of 10 to 50 mm. The angle $\theta$ between the spouting nozzle 35A and the nozzle 35B shown in FIG. 13 is preferably 60° to 180°. Further, the outer diameter of the hollow tubes 31 in this case is preferred to be chosen so that the cross sectional area of the gas flow part can be ½ or less the cross sectional area of the furnace. Further, in the embodiment of FIG. 12, the gas passing along the inner wall of the furnace is difficult to be divided; hence it is preferred to provide half-divided hollow tubes. The secondary air is preferably to be spouted at a high speed (e.g. 50 m/sec or higher).

When the embodiment of FIG. 12 is combined with the grating in FIG. 9, it is possible to improve the performance of such gas mixing more effectively.

Figure 14:
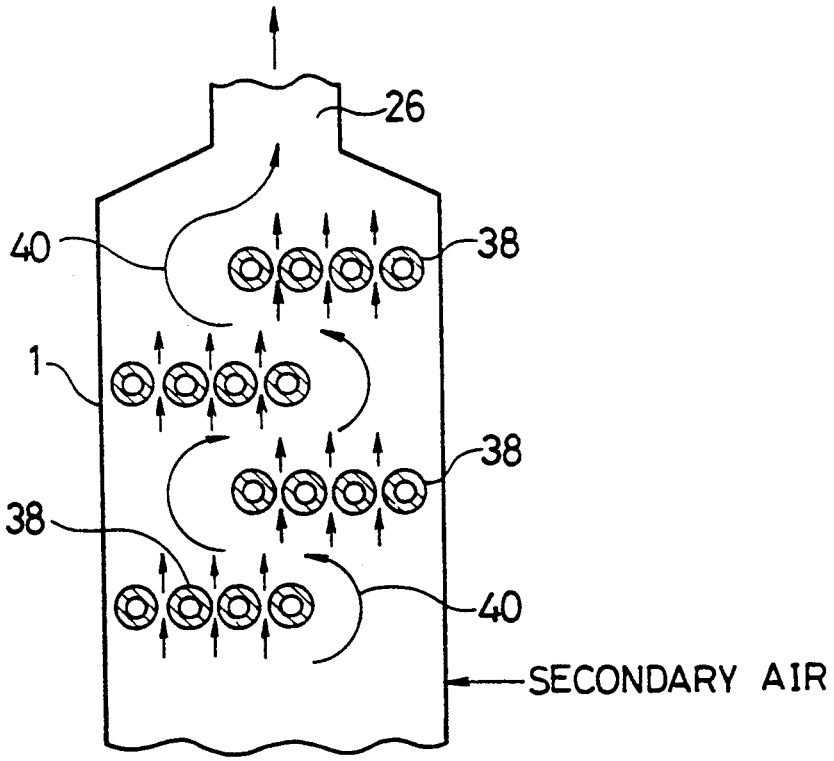
FIG. 14 shows a schematic view illustrating an embodiment of a furnace that promotes mixing of the secondary air with the combustion gas in the present invention.

FIG. 14 shows an embodiment of a gas-dividing means for promoting gas mixing, wherein a plurality of rows of tubes 38 are provided laterally on one side of the secondary combustion zone 34 and arranged alternately in the flow direction of the gas, whereby the gas flows in a zigzag form as a flow line 40, while it is divided by the rows of tubes 38, to promote combustion of unburnt matter in the secondary combustion part to effect a complete combustion.

According to the present invention by using a fluidized bed furnace having definite primary air diffusing tubes by way of a simple open-close control system, and by controlling the fluidized bed temperature within a definite range, to subject wastes to a mild combustion, it is possible to completely burn wastes under a condition free of unburnt matter, whatever the properties, size, form, etc. of wastes are. Thus, even when a small scale combustion furnace is employed, almost no unburnt matter is contained in the combustion exhaust gas, and black smoke, etc. do not occur so that it is possible to operate the furnace under a stable and safe condition; hence in the case of a boiler, the quantity of steam generated is stabilized. Further, since it is possible to set the air ratio at the time of combustion to a lower value than that in the case of a conventional fluidized bed combustion apparatus, the exhaust gas quantity can be reduced. Further, since it is possible to carry out stabilized combustion without depending upon the quantity and quality of combustibles, pretreatment equipment such as a crusher usually disposed in front of the furnace in the case of fluidized bed combustion of city wastes, etc. are unnecessary. Further, problems of heat spots, melt adhesion, etc. as caused in the case of mechanical furnaces, can also be easily avoided by selecting combustion conditions, and further since the tolerable ranges of the operation are broad, the ranges of choice of the combustion conditions relative to combustibles are broadened to a large extent; hence it is possible to apply the method of the present invention to any scale fluidized bed combustion furnace. Further, according to the present invention, it is possible to promote mixing of the combustion gas containing unburnt matter with the secondary air and thereby completely remove unburnt matter like CO, etc.

What is claimed is:

1. A fluidized bed combustion method for burning wastes using a fluidized bed furnace having a fluidized bed, a number of air-diffusing tubes of feeding a primary air to the fluidized bed arranged in parallel with each other at the bottom of the fluidized bed, and a free space part formed above the fluidized bed for burning unburnt matter with a secondary air, each said airdiffusing tube having a number of nozzles provided along the axis of the tube and a primary air control means including an open-close damper for controlling the quantity of air to be fed, which method comprises feeding said primary air into the fluidized bed through said air-diffusing tubes one after another according to a predetermined open-close control pattern by means of said primary air control means to burn the wastes so that the ratio of the air quantity Uo to the minimum fluidizing air quantity Umf (Uo/Umf) is in the range of 1.4 to 4 when said damper is opened and in the range of 0.5 to 2 when said damper is closed, the dampers being opened and closed at intervals of 1 to 10 seconds and 10 to 100 seconds, respectively.

2. A fluidized bed combustion method for burning wastes according to claim 1, wherein the temperature of the fluidized bed is controlled to fall within a range of 550° to 800° C. by adding an auxiliary fuel or water into the fluidized bed.

3. A fluidized bed combustion method for burning wastes according to claim 1, wherein said secondary air is fed along a flow direction of combustion gas at at least two points in said free space part.

4. A fluidized bed combustion method for burning wastes according to claim 1, wherein the wastes are burned in a circular form furnace and said primary air is introduced at at least two points in the circumferential direction of the wall of said furnace so as to form a whirling flow.

5. A fluidized bed combustion method for burning wastes according to claim 1, further including mixing combustion gas with the secondary air at a secondary combustion zone in the furnace.

6. A fluidized bed combustion method for burning wastes according to claim 5, wherein said mixing includes providing a grating just above the inlet of a secondary air of the furnace.

7. A fluidized bed combustion method for burning wastes according to claim 5, wherein said mixing includes providing a plurality of hollow tubes or rods horizontally penetrating through the secondary combustion zone of the furnace.

8. A fluidized bed combustion method for burning wastes according to claim 7, including providing said hollow tubes with secondary air-spouting nozzles at an under part thereof.

9. A fluidized bed combustion method for burning wastes according to claim 5, wherein said mixing includes providing a plurality of rows of tubes extending laterally on one side of the secondary combustion zone of the furnace and arranged alternately in the flow direction of the combustion gas to that the combustion gas flows in a zigzag path divided by the rows of tubes.

10. A fluidized bed combustion method for burning wastes according to claim 1, wherein said feeding of said primary air into the fluidized bed to said air-diffusing tubes one after another in the predetermined open-close control pattern includes closing the open-close damper of a present air-diffusing tube after an open interval of 5 seconds elapses and substantially simultaneously opening the open-close damper of a next air-diffusing tube to start an open interval of 5 seconds for the open-close damper of the next air-diffusing tube and thereafter repeating the opening and closing for each of the open-close dampers.

11. A fluidized bed combustion method for burning wastes according to claim 10, wherein said feeding of said primary air further comprises feeding said primary air into the fluidized bed through seven air-diffusing tubs one after another so that the open interval of 5 seconds of reach said open-close dampers results in a corresponding closed interval of 30 seconds, said open and closed intervals being repeated sequentially for each of the open-close dampers.

12. A fluidized bed combustion method for burning wastes according to claim 1, wherein said feeding of said primary air into the fluidized bed through said air-diffusing tubes one after another according to the predetermined open-close control pattern includes sequentially opening the open-close damper of a next air-diffusing tube after one half of the open interval of the open-close damper for a present air-diffusing tube has elapsed so that both of the open-close dampers for the present and next air-diffusing tubes are open for one half of the open interval.

13. A fluidized bed combustion method for burning wastes according to claim 12, wherein said feeding of said primary air through said air-diffusing tubes includes providing an open interval for each of the open-close dampers of 10 seconds.

14. A fluidized bed combustion method for burning wastes according to claim 13, wherein said feeding of said primary air through said air-diffusing tubes includes providing seven air-diffusing tubes so that the open interval for each said open-close damper is 10 seconds and the corresponding closed interval is 25 seconds.

* * * * *